US011266883B2

(12) United States Patent
Ianni et al.

(10) Patent No.: US 11,266,883 B2
(45) Date of Patent: Mar. 8, 2022

(54) SPORTS BALL WITH ELECTRONICS HOUSED IN SHOCK-ABSORBING CARRIER

(71) Applicant: DDSports, Inc., Merriam, KS (US)

(72) Inventors: Bruce C. Ianni, Mission Hills, KS (US); Davyeon D. Ross, Overland Park, KS (US); Michael Maziarz, Wilbraham, MA (US); Clint A. Kahler, Spring Hill, KS (US)

(73) Assignee: DDSports, Inc., Merriam, KS (US)

( * ) Notice: Subject to any disclaimer, the term of this patent is extended or adjusted under 35 U.S.C. 154(b) by 0 days.

(21) Appl. No.: 16/903,652

(22) Filed: Jun. 17, 2020

(65) Prior Publication Data

US 2020/0391084 A1 Dec. 17, 2020

Related U.S. Application Data

(60) Provisional application No. 62/862,232, filed on Jun. 17, 2019.

(51) Int. Cl.

| | |
|---|---|
| ***A63B 43/00*** | (2006.01) |
| ***A63B 41/02*** | (2006.01) |
| *A63B 45/00* | (2006.01) |

(52) U.S. Cl.

CPC ..... *A63B 43/004* (2013.01); *A63B 41/02* (2013.01); *A63B 45/00* (2013.01);
(Continued)

(58) Field of Classification Search

CPC ..... A63B 43/004; A63B 41/02; A63B 45/00; A63B 2220/833; A63B 2243/0037;
(Continued)

(56) References Cited

U.S. PATENT DOCUMENTS

| | | | | |
|---|---|---|---|---|
| 4,438,588 A | | 3/1984 | Martin | |
| 4,577,865 A | * | 3/1986 | Shishido | A63B 43/00 473/446 |

(Continued)

FOREIGN PATENT DOCUMENTS

| | | |
|---|---|---|
| EP | 1232772 A2 | 8/2002 |
| EP | 2472288 A1 | 7/2012 |

(Continued)

OTHER PUBLICATIONS

"Digi-Key's North American Editors, Inductive Versus Resonant Wireless Charging: A Truce May Be a Designer's Best Choice", Feb. 8, 2016, <https://www.digikey.com/en/articles/inductive-versus-resonant-wireless-charging>, retrieved on Aug. 12, 2021. (Year: 2016).*

(Continued)

*Primary Examiner* — Steven B Wong

(74) *Attorney, Agent, or Firm* — Grady L. White; Potomac Law Group, PLLC

(57) ABSTRACT

A sports ball includes sensing electronics embedded therein. The electronics are supported on an inner surface of the wall of the ball within an elastomeric boot that extends inwardly toward the center of the ball. The elastomeric boot is configured to protect the electronics from damage due to shock as the ball is used, and to have little if any effect on the performance characteristics of the ball.

16 Claims, 8 Drawing Sheets

(52) U.S. Cl.
CPC ..... *A63B 2220/833* (2013.01); *A63B 2225/50* (2013.01); *A63B 2243/0037* (2013.01)

(58) Field of Classification Search
CPC . A63B 2225/50; A63B 2225/54; A63B 41/04; A63B 2209/00; A63B 2024/0028; A63B 2225/01; A63B 2225/62; A63B 2225/15
See application file for complete search history.

(56) References Cited

U.S. PATENT DOCUMENTS 4,595,200 A * 6/1986 Shishido ..... A63B 43/00 473/570
5,236,383 A * 8/1993 Connelly ..... A63B 43/007 446/219
5,293,354 A 3/1994 Costabile
5,316,293 A 5/1994 Hamilton
5,526,326 A 6/1996 Fekete et al.
5,609,411 A * 3/1997 Wang ..... F21V 33/008 362/234
5,697,791 A 12/1997 Nashner et al.
5,776,018 A 7/1998 Simpson et al.
5,871,406 A 2/1999 Worrell
6,157,898 A 12/2000 Marinelli
6,177,861 B1 1/2001 MacLellan et al.
6,280,352 B1 8/2001 Coffeen et al.
6,389,368 B1 5/2002 Hampton
6,418,179 B1 7/2002 Shieh
6,514,160 B1 2/2003 Cooper
6,582,329 B1 6/2003 Cabrera
6,597,683 B1 7/2003 Gehring et al.
6,620,057 B1 9/2003 Pirritano et al.
6,944,148 B1 9/2005 Gehring et al.
6,946,950 B1 9/2005 Ueno et al.
6,960,999 B2 11/2005 Haimovitch et al.
7,091,863 B2 8/2006 Ravet
7,095,312 B2 8/2006 Erario et al.
7,133,396 B1 11/2006 Schmidl et al.
7,182,704 B2 2/2007 Levy
7,625,314 B2 12/2009 Ungari et al.
7,771,320 B2 8/2010 Riley et al.
7,843,348 B2 11/2010 Hayford et al.
7,854,669 B2 12/2010 Marty et al.
7,920,052 B2 4/2011 Costabile
7,949,295 B2 5/2011 Kumar et al.
8,038,549 B2 10/2011 Vann
8,079,925 B2 12/2011 Englert et al.
8,099,258 B2 1/2012 Alten et al.
8,231,487 B2 7/2012 Nurnberg et al.
8,248,212 B2 8/2012 Frederick
8,249,254 B1 8/2012 Daniel
8,289,170 B2 10/2012 Pryor et al.
8,360,904 B2 1/2013 Oleson et al.
8,465,382 B2 6/2013 Moye
8,517,869 B2 8/2013 Steidle
8,517,870 B2 * 8/2013 Crowley ..... A63B 41/00 473/570
8,540,560 B2 9/2013 Crowley et al.
8,579,632 B2 11/2013 Crowley
8,597,095 B2 12/2013 Crowley et al.
8,622,832 B2 1/2014 Marty et al.
8,663,040 B2 * 3/2014 Kortegast ..... A63B 71/0036 473/570
8,687,546 B2 4/2014 Gong et al.
8,702,430 B2 4/2014 Dibenedetto et al.
8,777,815 B2 7/2014 Case et al.
8,786,415 B2 7/2014 Cavallaro et al.
8,951,106 B2 2/2015 Crowley et al.
8,968,100 B2 3/2015 Hohteri
9,041,546 B2 5/2015 Pryor et al.
9,129,153 B2 9/2015 Ianni et al.
9,186,568 B2 11/2015 Ianni et al.
9,211,446 B2 * 12/2015 Berggren ..... A63B 43/004
9,254,432 B2 2/2016 Ianni et al.
9,308,417 B2 4/2016 Grundy
9,384,676 B2 * 7/2016 Costain ..... G09B 19/0038
9,502,018 B2 11/2016 Cronin et al.
9,517,389 B2 12/2016 Won
9,586,099 B2 * 3/2017 Holthouse ..... A63B 41/04
9,849,361 B2 12/2017 Coza et al.
9,858,451 B2 1/2018 Ianni et al.
9,971,916 B1 5/2018 Ianni et al.
10,076,685 B2 * 9/2018 King ..... A63B 15/02
10,159,888 B2 12/2018 Ianni et al.
10,232,225 B1 * 3/2019 Oberc ..... A63B 69/3658
10,238,941 B2 3/2019 Ianni et al.
10,434,376 B2 * 10/2019 Larson ..... A63B 41/00
10,799,769 B2 * 10/2020 Wolfinbarger ..... A63B 45/00
2002/0107092 A1 8/2002 Gottlieb-Myers et al.
2003/0054905 A1 3/2003 King
2003/0181268 A1 9/2003 Nelson
2003/0224885 A1 * 12/2003 Leal ..... A63B 43/06 473/570
2004/0145342 A1 7/2004 Lyon
2004/0160310 A1 8/2004 Chen et al.
2005/0223799 A1 10/2005 Murphy
2005/0225437 A1 10/2005 Shiotsu et al.
2005/0233815 A1 * 10/2005 McCreary ..... A63B 24/0021 473/131
2005/0261609 A1 11/2005 Collings et al.
2006/0052055 A1 3/2006 Rowse et al.
2006/0105857 A1 5/2006 Stark
2006/0135297 A1 * 6/2006 Cruciani ..... A63B 43/00 473/570
2006/0184705 A1 8/2006 Nakajima
2007/0021244 A1 * 1/2007 Ko ..... A63B 43/06 473/570
2007/0135243 A1 6/2007 LaRue et al.
2007/0173355 A1 7/2007 Klein
2007/0219024 A1 9/2007 Allegre
2007/0281811 A1 * 12/2007 Wang ..... A63B 43/06 473/570
2008/0015061 A1 1/2008 Klein
2008/0088303 A1 4/2008 Englert
2008/0274844 A1 11/2008 Ward
2008/0298280 A1 12/2008 Joshi et al.
2009/0048070 A1 2/2009 Vincent et al.
2009/0111616 A1 4/2009 Creelman
2009/0117525 A1 5/2009 Bavaro et al.
2009/0191988 A1 7/2009 Klein
2009/0256688 A1 10/2009 Khan
2010/0248622 A1 9/2010 Kirby et al.
2011/0054782 A1 3/2011 Kaahui
2011/0176464 A1 7/2011 Warner et al.
2011/0287878 A1 * 11/2011 Englert ..... A43B 3/0005 473/570
2012/0058845 A1 3/2012 Crowley et al.
2012/0316843 A1 12/2012 Beno et al.
2012/0322587 A1 12/2012 Duke
2012/0323496 A1 12/2012 Burroughs et al.
2013/0066448 A1 3/2013 Alonso
2013/0130843 A1 5/2013 Burroughs et al.
2013/0154387 A1 6/2013 Lee et al.
2013/0167290 A1 7/2013 Ezra
2013/0172131 A1 7/2013 Bove et al.
2013/0182718 A1 7/2013 Kim et al.
2013/0288600 A1 10/2013 Kuusilinna et al.
2014/0013361 A1 * 1/2014 Monari ..... H04N 21/6131 725/62
2014/0039651 A1 2/2014 Crowley
2014/0135150 A1 5/2014 Thurman et al.
2014/0135955 A1 5/2014 Burroughs
2014/0135956 A1 5/2014 Thurman et al.
2014/0135957 A1 5/2014 Thurman et al.
2014/0135958 A1 5/2014 Thurman et al.
2014/0135959 A1 5/2014 Thurman et al.
2014/0195019 A1 7/2014 Thurman et al.
2014/0195020 A1 7/2014 Thurman et al.
2014/0195021 A1 7/2014 Thurman et al.
2014/0195022 A1 7/2014 Thurman et al.
2014/0200103 A1 * 7/2014 Thurman ..... A63B 43/00 473/570
2014/0200692 A1 7/2014 Thurman et al.

(56) References Cited

U.S. PATENT DOCUMENTS

| | | | | |
|---|---|---|---|---|
| 2014/0222177 | A1 | 8/2014 | Thurman et al. | |
| 2014/0247817 | A1 | 9/2014 | Lim et al. | |
| 2014/0266759 | A1 | 9/2014 | Pryor et al. | |
| 2014/0274486 | A1 | 9/2014 | Thurman | |
| 2014/0274487 | A1 | 9/2014 | Thurman | |
| 2014/0277634 | A1 | 9/2014 | Thurman | |
| 2014/0277635 | A1 | 9/2014 | Thurman | |
| 2014/0277636 | A1 | 9/2014 | Thurman | |
| 2014/0364974 | A1 | 12/2014 | Wohl et al. | |
| 2014/0371885 | A1 | 12/2014 | Ianni et al. | |
| 2015/0071158 | A1 | 3/2015 | Fan et al. | |
| 2015/0112464 | A1 | 4/2015 | Crowley et al. | |
| 2015/0159846 | A1* | 6/2015 | Hollinger | H04N 5/77 362/183 |
| 2015/0265897 | A1 | 9/2015 | Gordon et al. | |
| 2015/0298558 | A1 | 10/2015 | Lewis | |
| 2015/0312493 | A1 | 10/2015 | Aldridge et al. | |
| 2015/0312494 | A1 | 10/2015 | Aldridge et al. | |
| 2015/0312497 | A1 | 10/2015 | Aldridge et al. | |
| 2015/0312504 | A1 | 10/2015 | Aldridge et al. | |
| 2015/0317801 | A1 | 11/2015 | Bentley et al. | |
| 2016/0074714 | A1* | 3/2016 | Krysiak | A63B 45/00 473/570 |
| 2016/0096067 | A1 | 4/2016 | Ianni et al. | |
| 2016/0099757 | A1 | 4/2016 | Leabman et al. | |
| 2016/0112727 | A1 | 4/2016 | Mate et al. | |
| 2016/0285299 | A1 | 9/2016 | Amand et al. | |
| 2016/0322853 | A1 | 11/2016 | Porat et al. | |
| 2017/0021229 | A1 | 1/2017 | Tasca et al. | |
| 2017/0040826 | A1* | 2/2017 | Arendarik | H02J 50/12 |
| 2017/0072283 | A1 | 3/2017 | Davisson et al. | |
| 2017/0128814 | A1 | 5/2017 | Ianni et al. | |
| 2017/0144030 | A1 | 5/2017 | King et al. | |
| 2017/0368425 | A1* | 12/2017 | Gordon | A63B 69/0071 |
| 2018/0015333 | A1 | 1/2018 | Binder | |
| 2018/0161656 | A1 | 6/2018 | Koo | |
| 2019/0305567 | A1* | 10/2019 | Keeley | H02J 50/402 |
| 2020/0330830 | A1* | 10/2020 | Carew-Jones | A63B 24/0021 |
| 2020/0391084 | A1* | 12/2020 | Ianni | A63B 43/004 |

FOREIGN PATENT DOCUMENTS

| | | | |
|---|---|---|---|
| JP | 2000061016 | A | 2/2000 |
| KR | 101280236 | B1 | 7/2013 |
| WO | 2001025946 | A1 | 4/2001 |
| WO | 2004009188 | A1 | 1/2004 |
| WO | 2006038163 | A1 | 4/2006 |
| WO | 2007006083 | A1 | 1/2007 |
| WO | 2007084850 | A2 | 7/2007 |
| WO | 2007130057 | A1 | 11/2007 |
| WO | 2012121434 | A1 | 9/2012 |
| WO | 2013029035 | A1 | 2/2013 |
| WO | 2015069123 | A1 | 5/2015 |

OTHER PUBLICATIONS

Baca et al. "Rapid feedback systems for elite sports training." Pervasive Computing, IEEE 5.4 (2006): 70-76.

Beetz et al. "Computerized real-time analysis of football games." Pervasive Computing, IEEE 4.3 (2005): 33-39.

Danner et al. "Description of the Physical Activity of Young Children Using Movement Sensor and Observation Methods," Pediatric Exercise Science. 1991.

http://shootersrev.com/product/evo-one-sensorized-baskelball/,Sep. 2014.

http://shop.94fifty.com, Sep. 2014.

http://swishmetrics.com, Sep. 2014.

http://vibradotech.com, Sep. 2014.

http://www.hooptracker.com, Sep. 2014.

http://www.noahbasketball.com/products, Sep. 2014.

http://www.shootaway.com, Sep. 2014.

http://www.wilson.com/smart/, Sep. 2014.

Introduction about Nintendo WII Software, Nintendo Korea, Jun. 24, 2010.

* cited by examiner

SPORTS BALL WITH ELECTRONICS HOUSED IN SHOCK-ABSORBING CARRIER

BACKGROUND AND FIELD OF THE INVENTION

The present invention relates generally to the field of sports and sports-related equipment, and more specifically to sports equipment like basketballs, footballs, and soccer balls containing embedded electronics such as printed circuit boards, antennas, transceivers, sensors, batteries, and battery-charging electronics.

In recent years, a number of sensor-based technologies have been developed to monitor athletes' performance in various sporting activities. As used herein, monitoring should be understood to refer broadly to tracking almost any parameter of an athlete's performance, including speed, acceleration, location of the player's body, position of the player's body, force applied to a sporting object (ball, puck, etc.), and so forth. In those cases where the behavior of the sporting object itself is being monitored using a sensor that is attached to or embedded within the sporting object, it is important for the behavior of the sporting object to be as unaffected as possible by the sensor and the structure that surrounds and protects the sensor within the ball. For example, it is known—generally speaking—to have a sensor within a basketball and to use the sensor to measure various parameters of the basketball (position, force applied to the basketball, acceleration, spin, trajectory, etc.) However, because the sport of basketball depends so much on dribbling (i.e., bouncing the ball), it is critical—and challenging—to embed a sensor in the ball in a way that does not change the shape or elasticity of the basketball, create a "dead spot" on the surface of the basketball, or otherwise negatively affect the basketball's bounce characteristics during dribbling, the basketball's rebound performance after striking the rim or the backboard on a basketball goal, or the rotation and trajectory of the basketball during the flight of a shot attempt.

SUMMARY OF THE INVENTION

The disclosure below features a sports object, e.g., a basketball, with an embedded sensor module. The sensor module includes electronic components, such as a sensor and a transmitter, configured to generate and broadcast a unique identification code associated with the sports object in which it is embedded. The unique identification code can be detected and used by an external receiver and computer system to track the location of the sports object. The sensor module is designed to insulate and protect the electronic components from shocks and vibrations associated with using the sports object in a game, without noticeably changing the sports object's normal performance characteristics.

Thus, in one aspect, the invention features a sports ball, which includes an inflatable bladder and a sensor module attached to the inner surface of the wall of the bladder. The sensor module extends internally into the bladder, toward the center of the ball, with the sensor module including an elastomeric boot and a sensor assembly disposed within a pocket in the elastomeric boot. The sensor assembly includes a radio transmitter, a rechargeable battery, and a wireless-resonant-charging coil configured to recharge the rechargeable battery. Typically, the radio transmitter, rechargeable battery, and wireless-resonant charging coil are all attached to a printed circuit board, which mechanically supports and electrically interconnects the components, or other supporting substrate. To minimize the effect on behavior of the ball, the wireless-resonant-charging coil is located, within the boot, at a position that is spaced a distance from the wall of the bladder (i.e., in a direction toward the center of the ball). In particular, because the wireless-resonant-charging coil is spaced from the wall of the bladder toward the center of the ball—using wireless resonant charging instead of inductive Qi-type charging as in other devices permits more spacing—the charging coil is less likely to be struck by the wall of the basketball as the basketball compresses when it is being bounced, even if the ball lands directly on the location of the sensor module.

In embodiments of a sports ball in accordance with the invention, the sensor assembly—in particular, the substrate—is oriented generally perpendicularly to the inner surface of the bladder. The wireless-resonant-charging coil may be oriented perpendicularly to the substrate, and located at an end of the substrate that is closer to the wall of the bladder. Suitably, the wireless-resonant-charging coil may be oriented generally parallel to the wall of the bladder in the vicinity of the point of attachment of the sensor module to the bladder, although it is envisioned that as wireless resonant charging technology advances, there will be greater freedom of design in terms of the particular orientation of the charging coil. Such advances could permit the wireless-resonant-charging coil to be arranged parallel to the substrate, e.g., in a stacked configuration.

Furthermore, the boot may conform tightly to the shape of the sensor assembly such that there is very little, if any, unoccupied space within the boot. Advantageously, the boot may include a longitudinally extending rib extending into the pocket to secure the sensor assembly within the pocket while maintaining a slight amount of free space within the boot. Advantageously, the boot is longitudinally symmetrical, or as symmetrical as possible, which makes vibration characteristics of the boot as isotropic as possible.

To enable electronic communications, the sensor assembly may have an antenna disposed on the substrate, e.g., on a side of the substrate that is opposite to the side of the substrate on which the battery is located. The antenna may be located at an end of the substrate that is opposite to the end of the substrate to which the wireless-resonant-charging coil is attached, e.g., at the end of the substrate closest to the center of the ball. Further still, the sensor assembly may comprise a chip-based, ultra-wide-band, radio-enabled device configured, for example, to transmit a unique identification code.

The sensor module may include a plug-shaped cap disposed within an end of the boot pocket that is closest to the inside wall of the bladder. The cap may include a circumferential rib located lengthwise approximately in the middle of the cap, and the boot pocket may include a circumferential groove—formed in a wall of the pocket—into which the circumferential rib fits to secure the cap, and therefore the sensor assembly, within the boot.

Suitably, the boot includes a flange by means of which the boot is secured to the wall of the bladder, e.g., by a self-vulcanizing process.

In another aspect, the invention features a sports ball, which includes an inflatable bladder and a sensor module attached to the inner surface of the wall of the bladder. The sensor module extends internally into the bladder, toward the center of the ball, with the sensor module including an elastomeric boot and a sensor assembly disposed within the elastomeric boot and extending beyond an open lower end of the elastomeric boot. The sensor assembly includes a radio transmitter, a rechargeable battery, and a wireless-resonant-charging coil configured to recharge the rechargeable battery. Typically, the radio transmitter, rechargeable battery, and wireless-resonant charging coil are all attached to a printed circuit board, which mechanically supports and electrically interconnects the components, or other supporting substrate. To minimize the effect on behavior of the ball, the wireless-resonant-charging coil is located, within the boot, at a position that is spaced a distance from the wall of the bladder (i.e., in a direction toward the center of the ball). In particular, because the wireless-resonant-charging coil is spaced from the wall of the bladder toward the center of the ball—using wireless resonant charging instead of inductive Qi-type charging as in other devices permits more spacing—the charging coil is less likely to be struck by the wall of the basketball as the basketball compresses when it is being bounced, even if the ball lands directly on the location of the sensor module.

BRIEF DESCRIPTION OF THE DRAWINGS

These and other further features of the invention will become clearer from the detailed description below as well as the accompanying drawings, in which.

DETAILED DESCRIPTION OF EMBODIMENTS OF THE INVENTION

Figure 1:
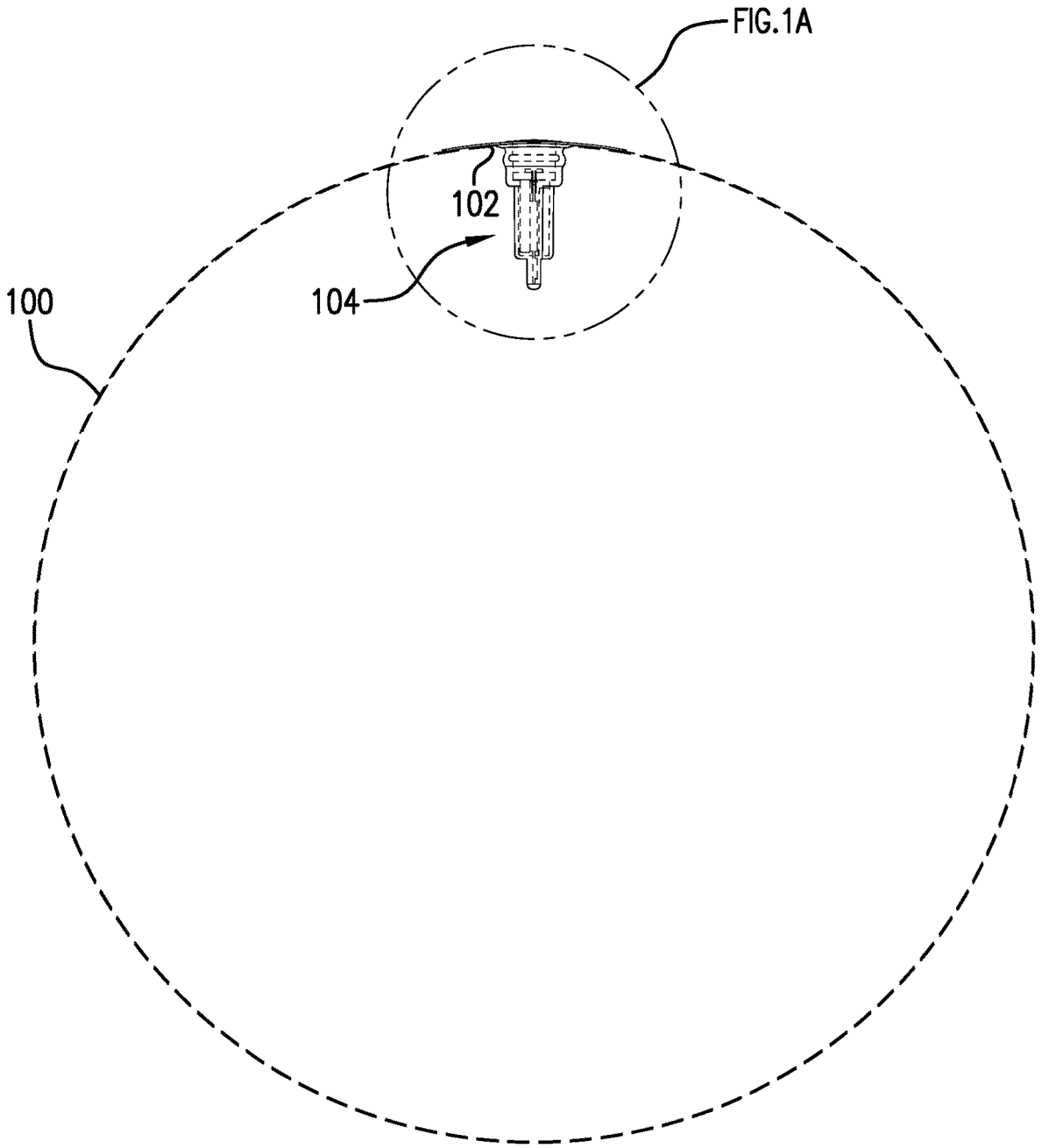
FIG. 1 is a schematic section view of a ball with an embedded sensor module in accordance with the invention, with FIG. 1A being an enlarged view of the circled portion of FIG. 1.
Figure 1A:
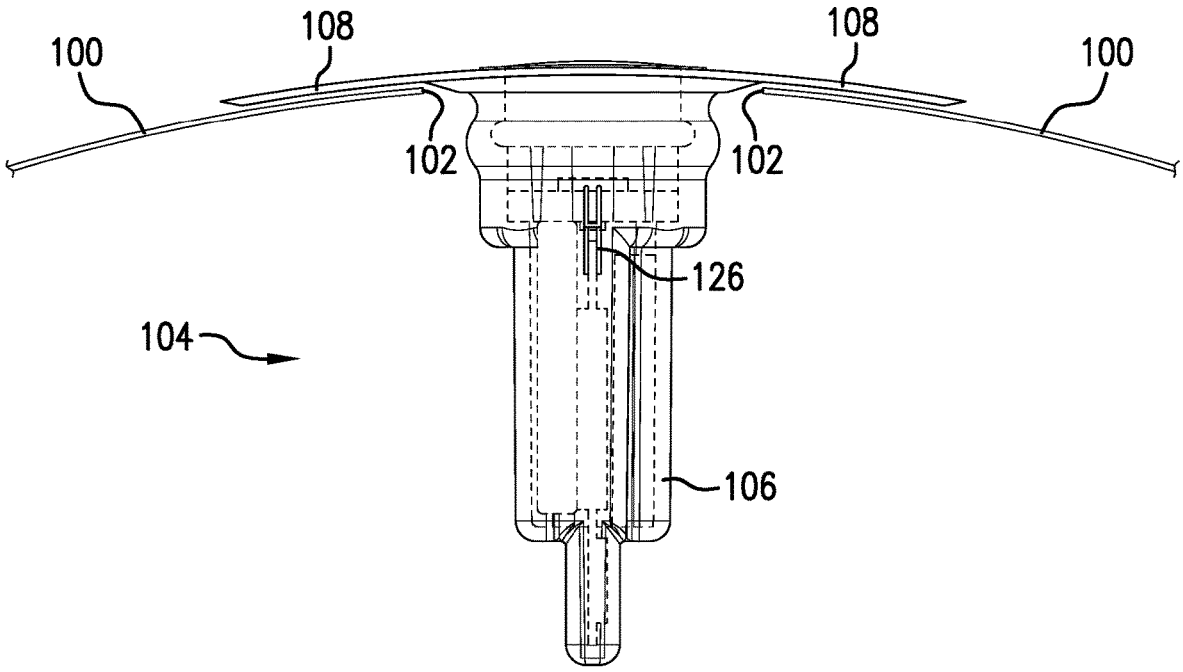
Figure 2A:
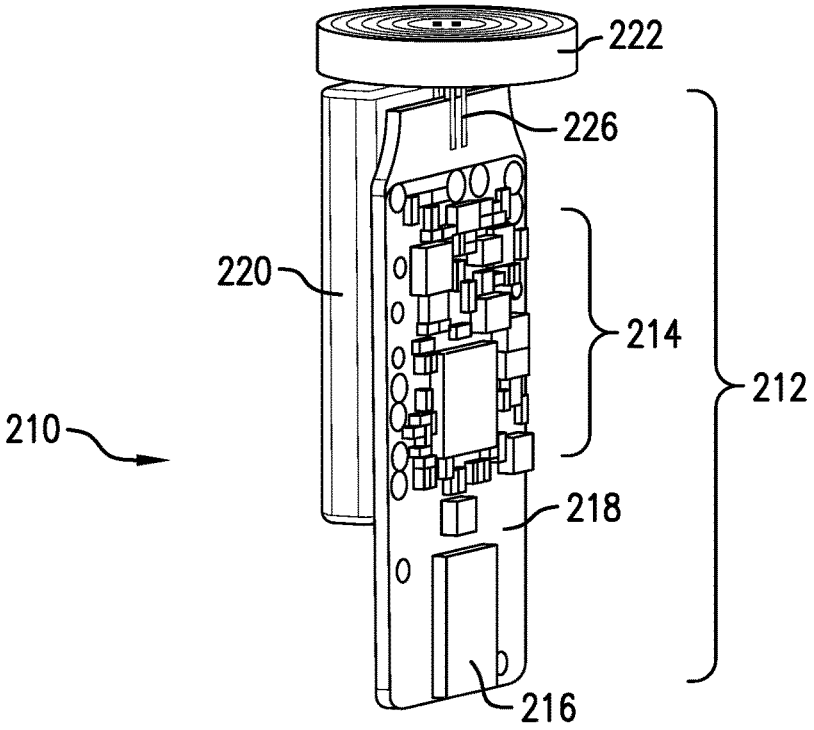
FIGS. 2A and 2B are three-dimensional renderings of a sensor assembly (part of the module illustrated in FIGS. 1 and 1A) in accordance with the invention, with FIG. 2A showing the sensor assembly before encapsulation of components and FIG. 2B showing the sensor assembly after encapsulation of components by overmolding with plastic.
Figure 2B:
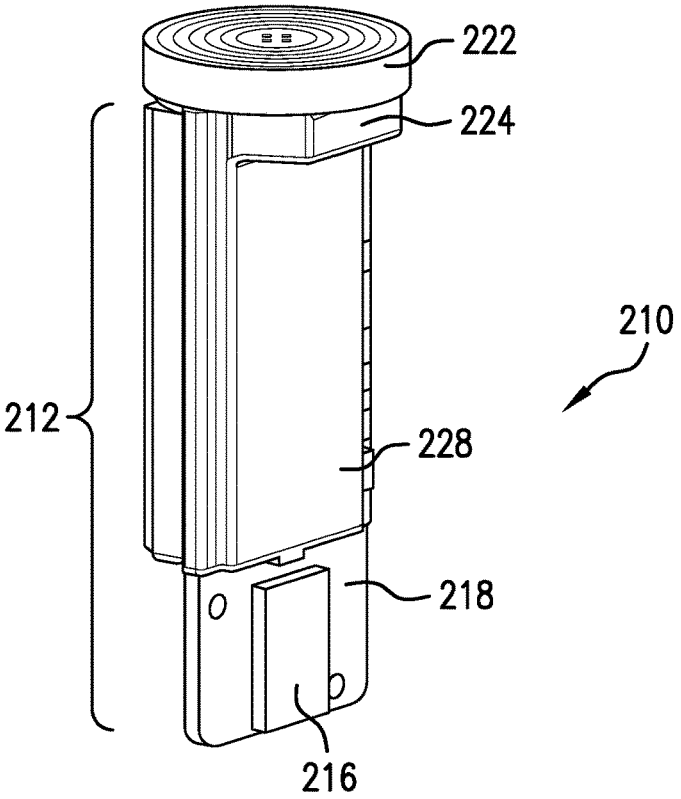
Figure 2C:
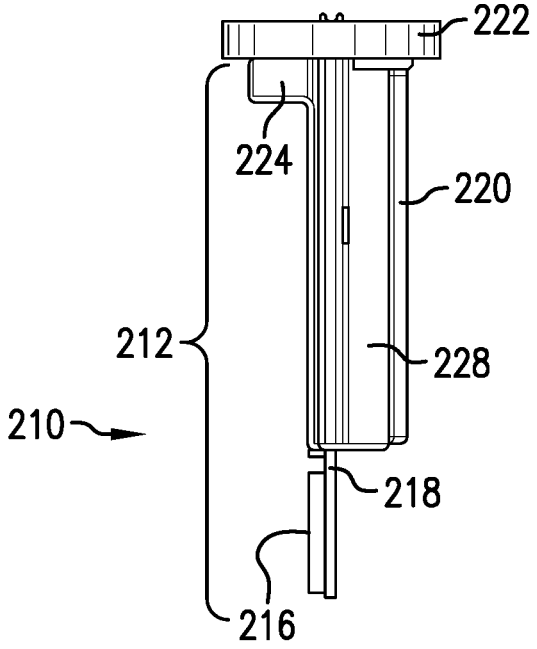
FIGS. 2C-2G are an edge view, side view of one side, side view of the other side, top view, and bottom view, respectively, of the sensor assembly shown in FIGS. 2A and 2B.
Figure 2D:
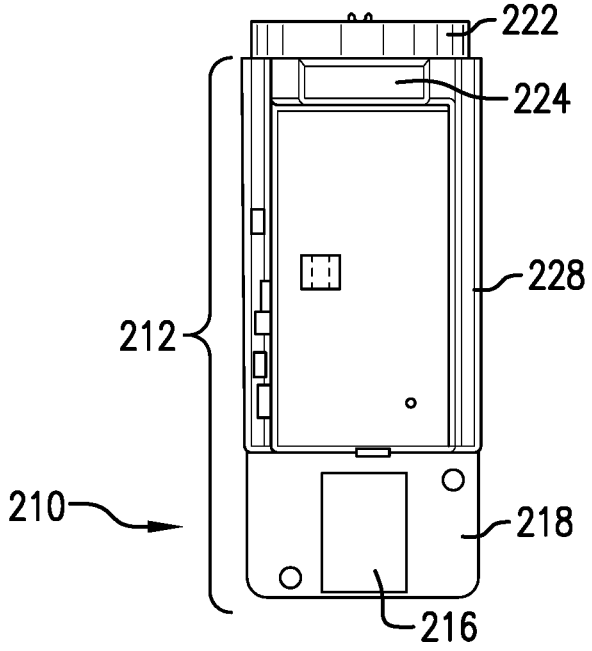
Figure 2E:
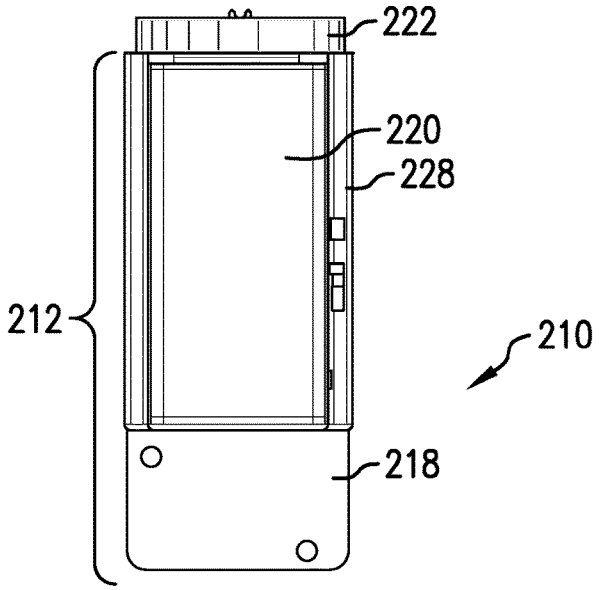
Figure 2F:
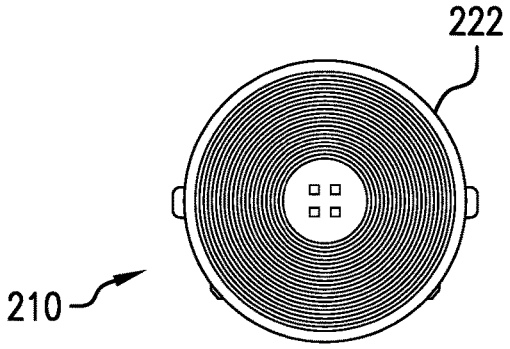
Figure 2G:
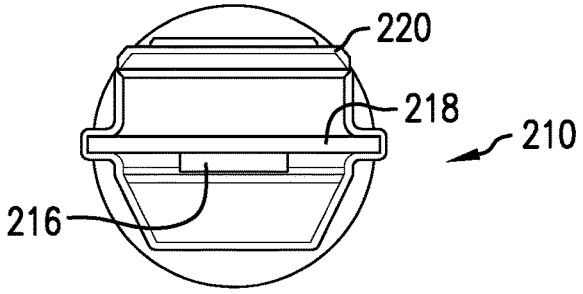

The placement of an internal sensor module 104 on an inside surface of an internal bladder 100 of a basketball in accordance with the invention is illustrated in FIGS. 1 and 1A. In general, the bladder 100 is fairly conventional, except that it includes a hole 102 to receive the internal sensor module 104. The sensor module 104 includes a chip-based sensor assembly (not labeled in FIGS. 1 and 1A but described in greater detail below), which is contained within a generally cup-shaped rubber boot 106. The boot 106 includes a circular flange 108 at its upper end (i.e., the end that will be located farthest from the center of the ball), which flange overlies and bonds to the outer surface of the bladder 100 by a self-vulcanization process.

To make a ball in accordance with the claimed invention, the bladder 100 is formed with the boot 106 attached to it. The bladder 100 is wound with threads, and a second layer of rubber is vulcanized over the threads to make a composite structure of the bladder, windings, and carcass. Then, the sensor assembly is installed into the boot 106; a cap (not labeled in FIGS. 1 and 1A but described in greater detail below) is installed; and then cover panels are laminated via contact cement to the composite structure now containing the sensor module. Alternatively, the sensor could be inserted after bladder winding, and then a second layer of rubber with an unvulcanized cap could be applied with vulcanizing performed as a subsequent step. This would produce a homogeneous surface of vulcanized rubber over the sensor.

Further details of the chip-based sensor assembly 210 are shown in FIGS. 2A-2G. In general, the sensor 212 may comprise a chip-based, ultra-wide-band (UWB), radio-enabled tag that is able to transmit a unique identification code that is specific to the particular ball in which the sensor 212 is embedded. Thus, the sensor 212 includes various chips and electronic components 214 and a transmitting/receiving antenna 216 mounted to printed circuit board 218, which interconnects the various electronic components, or to another supporting substrate. The sensor 212 also includes a rechargeable battery 220, e.g., a 115 mAh LiPo battery, mounted to the side of the printed circuit board 218 that is opposite to the side on which the antenna 216 is mounted (to avoid interference between the battery 220 and the antenna 216).

The sensor assembly 210 utilizes resonant wireless charging technology to recharge the battery 220. Therefore, the sensor assembly 210 also includes a resonant wireless charging coil 222. Resonant wireless charging is used instead of inductive Qi-type charging because the secondary, energy-receiving coil (i.e., the charging coil 222) can be located farther away from the charging source than in the case of inductive Qi-type charging. This allows the charging coil 222 to be positioned farther into the interior of the basketball than would be the case if inductive Qi-type charging were used, and positioning the charging coil 222 farther into the interior of the basketball helps to minimize or reduce the effect the coil 222 will have on the bouncing and rebound performance of the basketball.

Notably, the charging coil 222 is oriented perpendicularly to the printed circuit board 218 and is attached to the end of the printed circuit board 218 that is opposite to the end of the printed circuit board 218 on which the antenna 216 is mounted. This arrangement facilitates inserting the antenna-bearing end of the printed circuit board 218 as far into the interior of the basketball as possible, which is advantageous for localizing the exact position of the ball in space (e.g., by computer-implemented triangulation algorithms), while giving the charging coil 222 an optimal orientation for charging purposes, i.e., essentially parallel to the closest portion of the wall of the basketball (although it is envisioned that as wireless resonant charging technology advances, there will be greater freedom of design in terms of the particular orientation of the charging coil).

A charging-coil printed circuit board 224 is associated with the charging coil 222 and includes circuitry that controls operation of the charging coil 222 to charge the battery 220. The charging coil 222 and its associated printed circuit board 224 are connected to the sensor assembly 210 using a four-post printed-circuit-board connector 126 (FIG. 1A) to attach the charging-coil printed circuit board 224 to the sensor printed circuit board 218, with two of the posts being soldered to each of the two printed circuit boards 218, 224 respectively, and serving as "anchors." Once the battery 220 and the charging antenna 222 and its associated printed circuit board 224 have been assembled to the sensor printed circuit board 218, all components of the sensor assembly 210 are over-coated, e.g., with a rigid, urethane-type material 228 to hold the components together and prevent them from breaking free under the high-acceleration forces experienced during dribbling, etc. (Suitably, the face of the antenna 216 is not over-coated if it is a PCB antenna, to allow free transmission of signals from the antenna 216, but is overcoated if it is a chip-based antenna.)

Figure 3A:
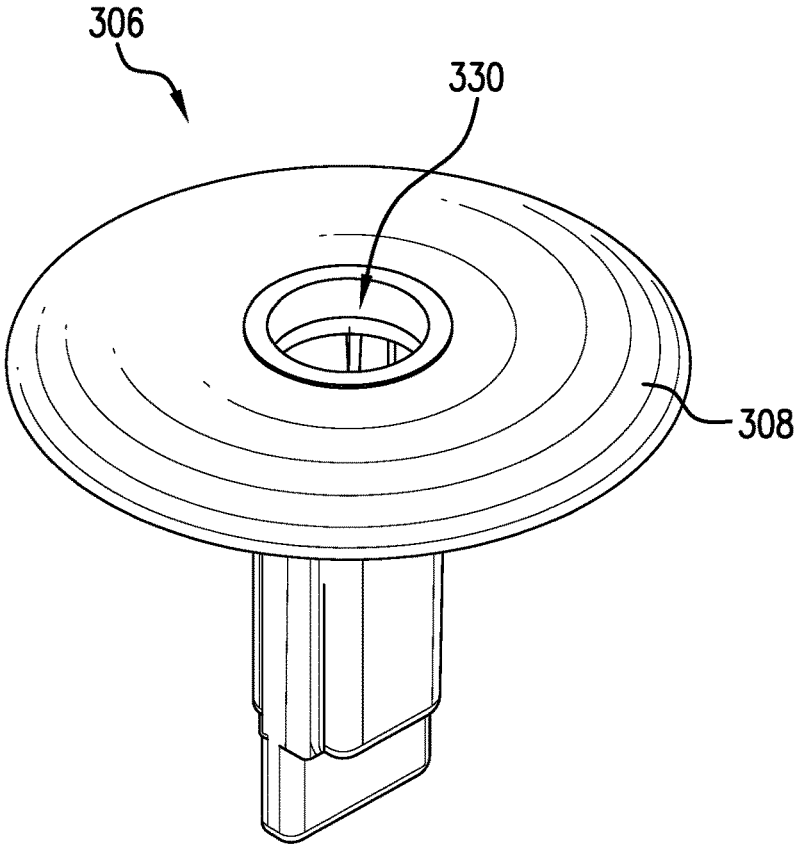
FIGS. 3A-3C are a perspective view, section view, and top view of sensor-housing boot (part of the module illustrated in FIGS. 1 and 1A) in accordance with the invention.
Figure 3B:
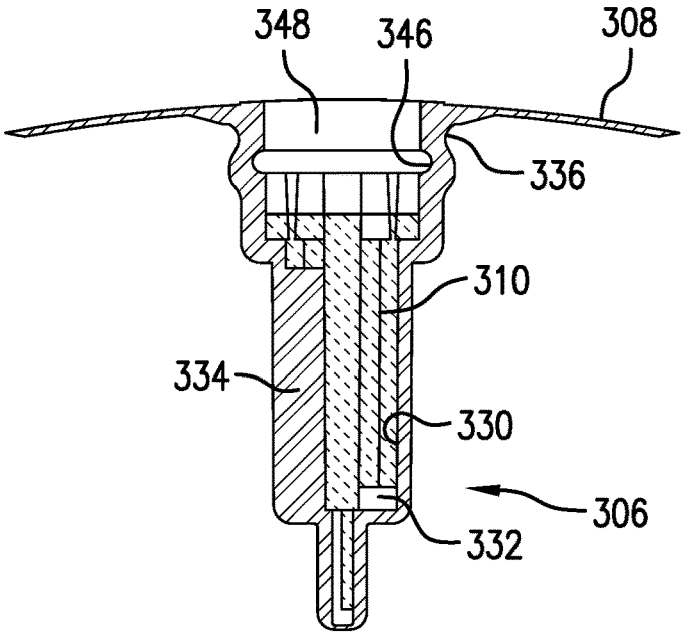
Figure 3C:
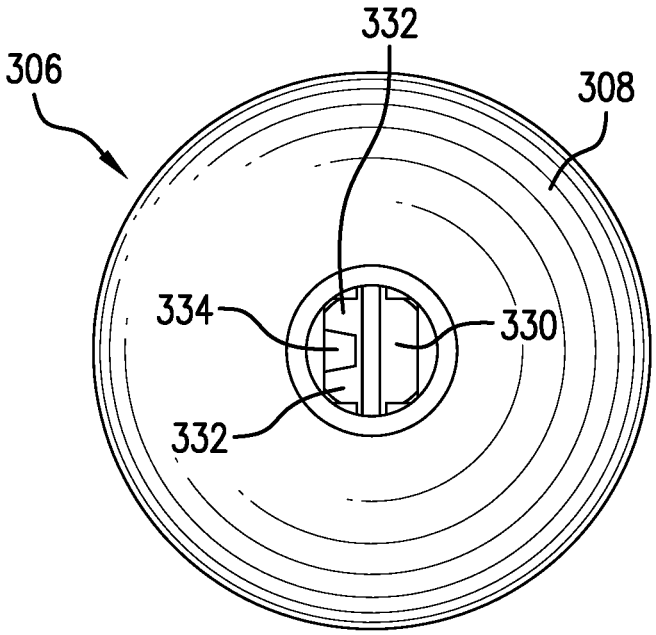

The boot 306 is illustrated in greater detail in FIGS. 3A-3C. As indicated above, the boot 306 is made from rubber, e.g., butyl rubber or a blend of butyl rubber and SBR (styrene-butadiene rubber), and is finished to 35-45 Shore A hardness. Additionally, as noted above, the boot 306 is generally cup-shaped, with an internal cavity or pocket 330 that is configured to receive the sensor assembly 310 (indicated by hatching in FIG. 3B) with relatively minimal excess space surrounding it. In other words, the boot 306 tightly conforms to the sensor assembly 310. This feature is important because if there is too much excess space within the boot 306, e.g., air-space 332, then pressure build-up within the excess space when the ball is inflated can tend to force the sensor assembly 310 out of the boot 306 and ball altogether. The sensor assembly 310 is able to fit far enough into the pocket 330 for the charging coil 222 to be located at a position that is a distance from the wall of the bladder (i.e., in a direction toward the center of the ball).

On the other hand, some air space, or air conduit, is desirable, to make it easier to insert the sensor assembly 310 fully into the pocket 330 or to remove the sensor assembly 310 from the pocket 330, if necessary. If there is no air space or conduit for air to enter into or escape from the pocket, then a bubble of air trapped within the pocket 330 could prevent the sensor assembly 310 from being inserted fully into the pocket 330 (due to difficulty of compressing such a trapped bubble of air), or vacuum forces could prevent the sensor assembly 310 from being withdrawn from the pocket 330. Therefore, to provide a small amount of excess space while still keeping the sensor assembly 310 well secured within the pocket 330, as well as to strengthen the pocket 330, a rib 334 extends longitudinally along a wall of the pocket 330. The rib 334 protrudes radially far enough into the interior of the pocket 334 to bear against the side of the sensor assembly 330 that does not contain the battery, and an air conduit is formed on either side of the rib.

Advantageously, the boot is longitudinally symmetrical, or as symmetrical as possible, which makes vibration characteristics of the boot as isotropic as possible.

Near the top of the boot 306, a groove 336 extends circumferentially around the exterior surface of the boot 336, just below the flange 308. The vibrational characteristics of the overall sensor module can be "tuned" to minimize the effect on performance of the basketball by adjusting the depth and radius of curvature of the groove 336.

Figure 4:
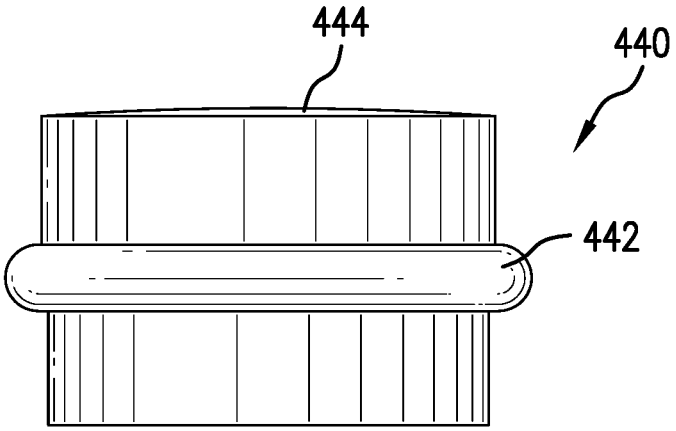
FIG. 4 is a side view of a cap used to enclose the sensor assembly shown in FIGS. 2A-2G within the boot shown in FIGS. 3A-3C.

Once the sensor assembly 310 has been fully inserted into the pocket 330 within the boot 306, the pocket 330 is closed using a plug-shaped cap 440, which is illustrated in FIG. 4. The cap 440 may be made from the same material as the boot 306. The cap 440 is generally cylindrical and has a rib 442 that extends circumferentially around the surface of the cap, essentially half-way between the upper and lower ends of the cap 440, as well as a slightly rounded upper end 444. The rib 442 fits within a groove 346 that extends circumferentially around the wall of the pocket 330 near the upper, socket-shaped end 348 of the pocket 330 to secure the cap 440 within the boot 308. The upper end 444 of the cap 440 is rounded to match the curvature of the bladder 100 of the ball when it is inflated, thereby minimizing the effect on the shape and hence performance of the ball.

Figure 5A:
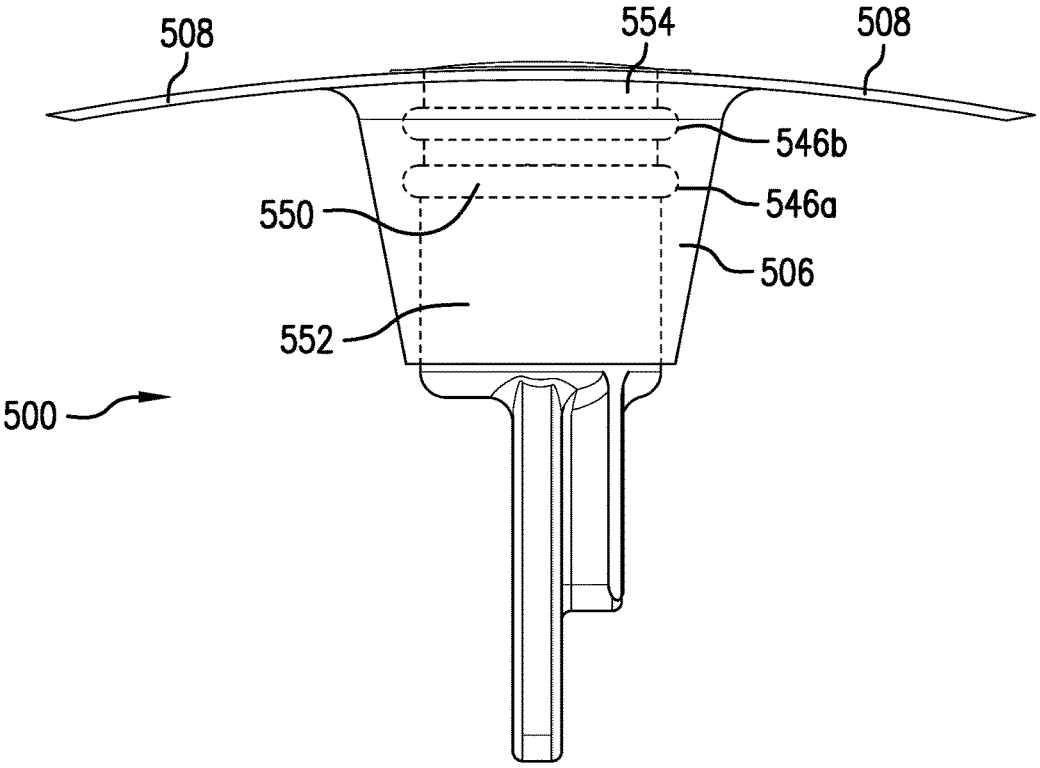
FIGS. 5A and 5B are two perspective views, from slightly different angles, illustrating a further embodiment of the invention.
Figure 5B:
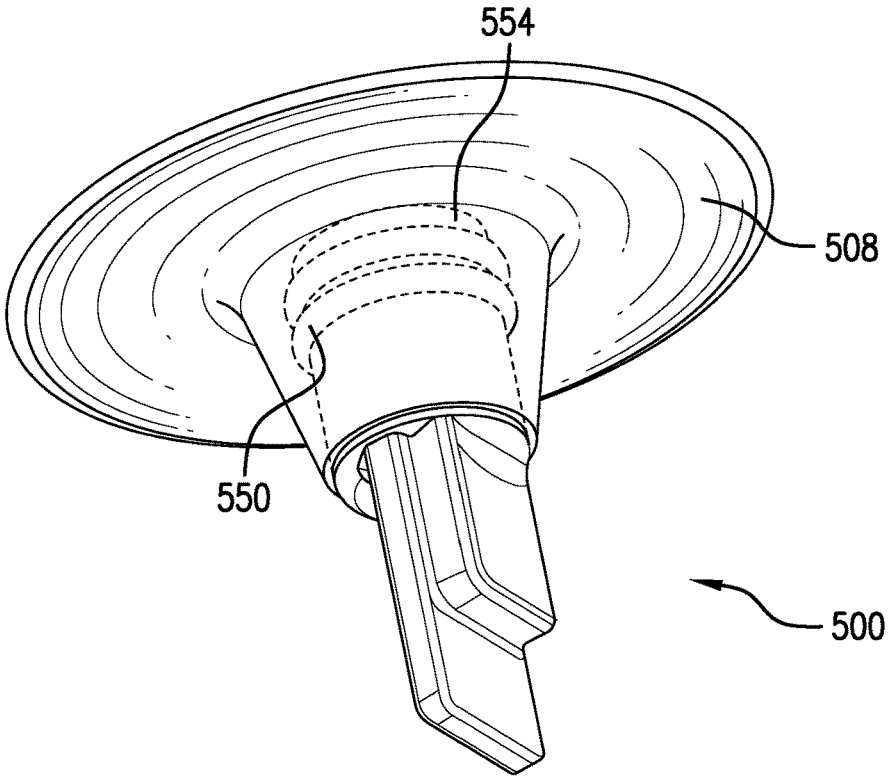

A further embodiment 500 of a housed/supported sensor assembly in accordance with the invention is illustrated in FIGS. 5A and 5B. In this embodiment, which would be installed in a ball that is fabricated in the same manner as described above with respect to FIG. 1, the rubber boot 506 is formed as a truncated cone, with an open lower end (i.e., the end that is closer to the center of the ball in which the sensor is embedded). This open-ended, truncated-cone configuration helps reduce the weight of the sensor "package" so that the ball in which the sensor is embedded performs even more like a standard ball that does not have the embedded sensor.

The sensor assembly used in this embodiment—i.e., the printed circuit board, the various chips and electronic components, and the transmitting/receiving antenna, including their assembly and arrangement—are the same as or generally similar to the sensor assembly used in the embodiment described above. Like the above-described sensor assembly, the sensor assembly used in the embodiment illustrated in FIGS. 5A and 5B is encapsulated within a polyurethane "shell" formed by overmolding with plastic or other covering material.

As illustrated, the boot 506 has a pair of grooves 546*a* and 546*b* that extend circumferentially around the central opening, and the sensor assembly has a ring-shaped rib 550 that extends circumferentially around the outer end of it. Thus, the sensor assembly is inserted into the central opening of the boot 506 and pushed toward the center of the ball until the ring-shaped rib 550 of the sensor assembly engages in the lower (i.e., innermost) groove 546*a* in the boot, with the sensor assembly protruding from the open lower end of the boot 506.

A plug 552, which also has a circumferentially extending ring-shaped rib 554, is then inserted into the central opening of the boot 506, above the sensor package, and pressed forward until the ring-shaped rib 554 of the plug engages with the upper groove 546*b* in the boot. This secures the sensor assembly in position.

It will be appreciated that the foregoing description of preferred embodiments is for explanatory purposes only, and that various modifications to and departures from the disclosed embodiments will occur to those having skill in the art. What is intended to be covered by Letters Patent is set forth in the following claims.

We claim:

1. A sports ball, comprising:

an inflatable bladder; and a sensor module attached to the inner surface of the wall of the bladder and extending internally into the bladder, toward the center of the ball, with the sensor module comprising an elastomeric boot with an open lower end and a sensor assembly disposed within a pocket in the elastomeric boot and extending beyond the open lower end of the elastomeric boot;

wherein the sensor assembly includes a substrate; a rechargeable battery secured to one side of the substrate; and a wireless-resonant-charging coil connected to an end of the substrate and arranged to recharge the rechargeable battery, with the wireless-resonant-charging coil being located, within the boot, at a position that is spaced a distance from the wall of the bladder in a direction toward the center of the ball; and wherein the substrate, the rechargeable battery, and the wireless-resonant-charging coil are overmolded and encased within a covering material.

2. The sports ball according to claim 1, wherein the wireless-resonant-charging coil is oriented perpendicularly to the substrate.

3. The sports ball according to claim 2, wherein the wireless-resonant-charging coil is located at an end of the substrate that is closer to the wall of the bladder than the opposite end of the substrate is located and the wireless-resonant-charging coil is generally parallel to the wall of the bladder in the vicinity of the point of attachment of the sensor module to the bladder.

4. The sports ball according to claim 1, wherein the boot conforms substantially to the shape of the sensor assembly.

5. The sports ball according to claim 4, wherein the boot includes a longitudinally extending rib extending into the pocket to secure the sensor assembly within the pocket while maintaining a slight amount of unoccupied space within the boot.

6. The sports ball according to claim 1, further comprising an antenna disposed on the substrate.

7. The sports ball according to claim 6, wherein the antenna is located on a side of the substrate that is opposite to the side of the substrate on which the battery is located.

8. The sports ball according to claim 6, wherein the antenna is located at an end of the substrate that is opposite to the end of the substrate to which the wireless-resonant-charging coil is attached.

9. The sports ball according to claim 6, wherein the antenna is located at an end of the substrate that is closest to the center of the ball.

10. The sports ball according to claim 1, further comprising a radio transmitter connected to the substrate, the radio transmitter configured to transmit a unique identification code that is specific to the ball.

11. The sports ball according to claim 10, wherein the radio transmitter is a chip-based, ultra-wide-band radio transmitter.

12. The sports ball according to claim 1, further comprising a plug-shaped cap disposed within an end of the pocket that is closest to the bladder.

13. The sports ball according to claim 12, wherein the cap includes a circumferential rib located approximately in the middle of the cap in the lengthwise direction and the pocket includes a circumferential groove formed in a wall thereof and the circumferential rib fits within the circumferential groove to secure the cap, and therefore the sensor assembly, within the boot.

14. The sports ball according to claim 1, wherein the boot includes a flange by means of which the boot is secured to the wall of the bladder.

15. The sports ball according to claim 1, wherein the substrate comprises a printed circuit board.

16. The sports ball according to claim 1, wherein the boot is longitudinally symmetrical.

* * * * *